US006082639A

United States Patent [19]

Pentz et al.

[11] Patent Number: 6,082,639

[45] Date of Patent: Jul. 4, 2000

[54] APPARATUS FOR INCREASING THE DENSITY OF BLOWN INSULATION MATERIALS

[75] Inventors: Edward Pentz, Boyertown; David M. Kawano, Lansdale; Thomas Cuthbertson, Royersford; Maurice J. Kelley, Paoli, all of Pa.

[73] Assignee: Certainteed Corporation, Valley Forge, Pa.

[21] Appl. No.: 09/236,431

[22] Filed: Jan. 25, 1999

[51] Int. Cl.[7] ..... B05B 1/26

[52] U.S. Cl. ..... 239/655; 239/499; 239/522

[58] Field of Search ..... 239/654, 655, 239/499, 518, 521, 522

[56] References Cited

U.S. PATENT DOCUMENTS

| | | | |
|---|---|---|---|
| 566,251 | 8/1896 | Tuttle | 239/654 |
| 867,806 | 10/1907 | Ditchfield | 239/522 X |
| 3,174,251 | 3/1965 | West | 239/654 X |
| 3,881,653 | 5/1975 | Birckhead | 239/521 X |

FOREIGN PATENT DOCUMENTS

| | | | |
|---|---|---|---|
| 23326 | 12/1914 | United Kingdom | 239/521 |
| 224820 | 11/1924 | United Kingdom | 239/521 |

*Primary Examiner*—Lesley D. Morris
*Attorney, Agent, or Firm*—Duane Morris & Heckscher LLP

[57] ABSTRACT

A dispenser for a blown fibrous insulation delivery system which is attached to a fibrous material delivery conduit of the system. The dispenser includes a pipe having a first end which is attachable to the delivery conduit and second end which carries a deflector for compressing a flow of fibrous insulation discharged through the outlet of the pipe and for changing the direction of flow of fibrous insulation compressed thereby. The deflector includes a substantially planar portion disposed at an acute angle with respect to the pipe outlet. The dispenser may also include a second deflector for changing the direction of flow of the compressed fibrous insulation.

9 Claims, 2 Drawing Sheets

APPARATUS FOR INCREASING THE DENSITY OF BLOWN INSULATION MATERIALS

FIELD OF THE INVENTION

The present invention relates in general to apparatus for dispensing fibrous insulation materials and in particular to apparatus for increasing the density of blown fibrous insulation as such insulation is discharged from the apparatus.

BACKGROUND OF THE INVENTION

Because of cost-effectiveness, speed and ease of application, as well as thoroughness of coverage in both open and confined areas, the practice of using pneumatically delivered or "blown" fibrous insulation materials, e.g., fiberglass, has become an increasingly popular method by which to install insulation in new and existing building constructions. The essential components of a typical blown fiberglass delivery system include a source of fiberglass material, conduit means for conveying the glass fibers from the fiberglass source to the installation site and a source of pressurized air such as a compressor, blower or the like, for generating a flow of pressurized air for entraining the fiberglass and delivering it from the fiberglass source through the conduit means for discharge at the installation site.

In order to promote efficient use of energy required to heat and/or cool new buildings, many building codes require that new buildings be constructed to provide a certain minimum resistance to heat flow. To achieve this threshold, insulation is typically installed between one or more of the buildings interior and exterior walls and possibly in superstructure and foundation areas such as crawl spaces, attics and basements. "R-value" refers to an insulation's thermal resistance or resistance to heat flow. The higher an insulation's R-value, the greater its thermal insulation capability. Existing building constructions can increase the R-value of their insulation by supplementing existing insulation with additional insulation.

The most influential factors for achieving a desired R-value when installing blown or pneumatically delivered fibrous installation are the thickness and density of the material to be installed. In "open" areas such as attics, for example, insulation thickness or density is not normally of great concern. However, in confined areas such as the voids between interior and building walls the available insulation space may be quite limited. This physical constraint restricts installation of blown insulation beyond a certain thickness and thus may materially impact the available R-value for insulation present in such areas.

SUMMARY OF THE INVENTION

A desire exists, therefore, for a method and apparatus for increasing the density of pneumatically delivered fibrous insulation at the placement site thereof whereby relatively thin and dense layers of insulation may be easily, reliably and rapidly deposited.

Other details and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
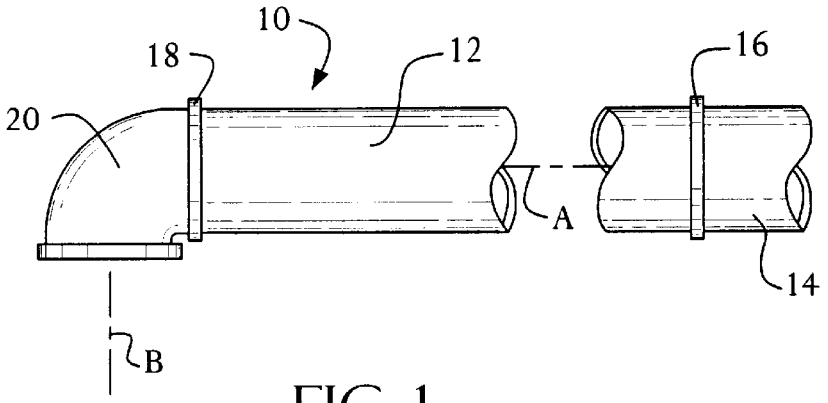
FIG. 1 (PRIOR ART)
FIG. 1 is a side view of a conventional fibrous insulation delivery system dispensing apparatus.

Referring to the drawings wherein like references indicate like or similar elements throughout the several figures, there is shown in FIG. 1 the dispensing apparatus 10 of a conventional fibrous insulation delivery system. The essential components of any fibrous insulation delivery system include a source of fibrous insulation material such as fiberglass or the like, conduit means, a compressor, blower or the like, and a dispensing apparatus attached to the distal end of the conduit means. The compressor or blower generates a flow of pressurized air for entraining the fibrous insulation material and delivering it from the insulation source through the conduit means to the dispensing apparatus for discharge at the installation site. Only those fibrous insulation material delivery system components which form a part of the present invention will be described in detail herein.

Conventional dispensing apparatus 10 include a lightweight rigid, metal or plastic pipe 12 of about 2 to about 4 inches in diameter, typically about 3 to about 4 inches in diameter. Although it may be permanently affixed thereto, pipe 12 is normally releasably attached at its rearward end to the distal and at a flexible delivery conduit 14 via suitable means 16 such as adhesive tape, threading, clamp means, or the like. The forward end of pipe 12 may likewise permanently or releasably attached via suitable means 18 to an optional tubular fitting member 20. Pipe 12 may range in length from about the width of a user's palm, i.e., about 4 inches, up to about 8 feet whereby the pipe may be manually grasped and manipulated to dispense insulation to open areas such as attics to confined and/or inaccessible areas such as, for example, the void spaces between the interior and exterior walls of a building.

Fitting member 20 is provided to promote precise placement of the insulation material and is normally constructed from the same or similar material as pipe 12 and may be fixedly or releasably attached thereto. Fitting member 20 is formed as a continuously curved circular cross-section pipe section of the same or substantially same internal diameter as pipe 12. The fitting member 20 changes the direction of flow of the fibrous insulation through the dispensing apparatus 10 from substantially parallel to the longitudinal axis "A" of pipe 12 to substantially parallel to the outlet or discharge axis "B" may be of the fitting member, which fitting member discharge axis B is typically angularly oriented from about 20° to about, as illustrated, 90° with respect to pipe axis A.

The continuously covered walls of the pipe fitting member 20, both in the direction of insulation flow and transverse thereto, create a passageway for effectively redirecting the flow path of the insulation which offers minimal resistance to the flowing insulation. Fitting member 20 possesses no means for meaningfully compressing the fibrous insulation discharged from dispensing apparatus 10. The density of fibrous insulation thus remains substantially unchanged as it enters, traverses and exits the dispensing apparatus. Consequently, dispensing apparatus 10 is of limited utility when it is desirable or necessary to install a dense, comparatively thin layer of high R-value blown fibrous insulation in a confined building space, e.g., the voids between interior and exterior building walls.

Figure 2:
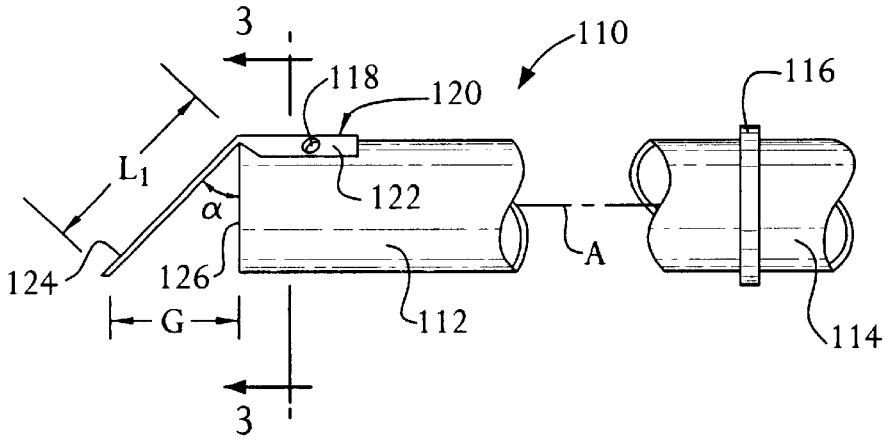
FIG. 2 is a side view of a fibrous insulation delivery system dispensing apparatus constructed in accordance with a first embodiment of the present invention.
Figure 3:
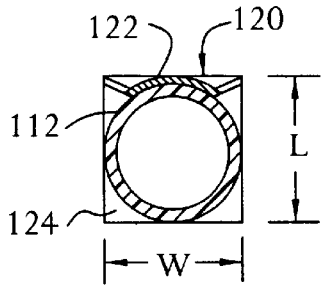
FIG. 3 is a cross-section view taken along line 3—3 of FIG. 2.

FIGS. 2 and 3 reveal a first embodiment of a dispensing apparatus according to the present invention. The dispensing apparatus, identified generally by reference numeral 110, comprises a circular, cylindrical, rigid pipe 112 which may be formed of the same or similar materials and may assume the same or similar dimensions as pipe 12 of the conventional fibrous insulation dispensing apparatus 10 discussed above.

The rearward end of pipe 112 may be permanently or releasably attached to the distal end of a flexible conduit delivery conduit 114 of a conventional fibrous insulation material delivery system via means 116, which means may be the same or similar to means 16 discussed above. Dispensing apparatus 110 further comprises deflector means 120, the function of which will be described in greater detail hereinafter. Deflector means 120 preferably includes an attachment portion 122 and a deflector portion 124. Deflector means 120 is preferably although not necessarily a unitary member which may be fabricated from any suitable rigid material such as steel, stainless steel, aluminum, wood or high strength, inelastic plastics such as, for example, ultra high molecular weight polyethylene. The attachment portion 122 is preferably contoured for close fitting contact with the outer circumference of pipe 112 and may be mechanically secured thereto by fastening means 118 such as one or more screws or the like. So secured the deflector means 120 may be detached from the pipe 112 when maintenance or replacement of the pipe or deflector means is desired or necessary. If a more permanent connection is desired, the attachment portion 122 of the deflector means 120 may be welded, soldered, brazed, fused, adhered or otherwise fixedly attached to pipe 112 consistent with the material characteristics of pipe 112 and attachment portion 122. Alternatively, deflector means 120 may be formed integrally with pipe 112 thereby eliminating the need for attachment portion 122 and subsequent physical attachment of the deflector means to the pipe.

In accordance with the present invention, deflector portion 124 is preferably substantially planar or, more preferably, truly planar and may extend at an angle $\alpha$ of between about 30° to about 70° with respect to the outlet 126 of pipe 112. The deflector portion 124 preferably presents a flat, untextured face toward pipe outlet 126, although it may be wavy, ridged, corrugated or otherwise textured inner face. And, to the extent the deflection portion 124 may be substantially planar, it may in fact have a mild concave curvature although the radius of such curve should be considerably greater than the radius of pipe 112.

The length "$L_1$" of deflector portion 124 is preferably sufficient to span the entire diameter of outlet 126. The width "W" of the deflector portion 124 may be substantially constant and at least as great as the diameter of the pipe outlet such that the deflector portion is configured substantially as a rectangle in the manner depicted in FIG. 3. Alternatively, however, to facilitate its passage through especially confined spaces, deflector portion 124 may be substantially circular or elliptical in shape. Hence, the width W of deflector portion 124 may increase from its point of attachment to pipe 112 whereupon it reaches a maximum at about half of length $L_1$ and thereafter decreases to a minimum at its distal or free end. Regardless of the perimetrical shape of deflector portion 124, however, it should be dimensioned such that its orthogonal projection onto pipe outlet 126 is sufficient to entirely cover the pipe outlet. In this way, substantially all fibrous insulation which is discharged by the pipe 112 impinges upon the deflector portion whereby it may be compressed and beneficially densified thereby.

Pneumatically delivered fibrous insulation typically comprises macerated fiberglass whose individual fiber lengths may range from about 0.25 inches to about 2.0 inches and diameters may range from about 1.0 to 10.0 microns. The insulation may optionally include binders or other additives to enhance its cohesiveness, flowability, durability or other beneficial processing or performance characteristics. With or without binders, however, the density of such materials as presently deposited by conventional dispensing apparatus such as apparatus 10 shown in FIG. 1 is about 0.4 to about 0.5 lb/ft$^3$. By comparison, similar fibrous insulation discharged by dispensing apparatus 110 and later-described dispensing apparatus 210 and 310 is compressed by virtue of its forceful contact with at least one deflector means such that its as-deposited or installed density is about 0.6 to about 1.0 lb/ft$^3$. Hence, the present dispensing apparatus may install fibrous insulation with at least about 10 percent and up to about 100 percent greater density than existing dispensing apparatus such as apparatus 10. As a practical consequence, the instant apparatus may install thinner layers of blown fibrous installation having R-values comparable to thicker layers of insulation blown by existing dispensing apparatus. Similarly, for insulation layers of similar composition and thickness deposited by the present dispensing apparatus versus conventional dispensing apparatus, the R-value of the layer deposited by the present dispensing apparatus will be greater.

The operation of dispensing apparatus 110 is as follows. The pressurized air source of the fibrous insulation system is activated to generate a flow of pressurized air of sufficient velocity to entrain fibrous insulation from the supply thereof whereby the entrained insulation may be conveyed through conduit means 114 and into pipe 112. The moving insulation passes through the pipe 112 and exits outlet 126 whereupon it forcefully strikes or impinges upon the rear face of deflector portion 124 of deflector means 120 to deplete the insulation of much of its forward kinetic energy and momentum. This now slower moving insulation is concurrently struck from behind, compressed and densified by a stream of continuously flowing insulation. The densified insulation is then discharged through mouth or gap G and onto the installation site. This process proceeds continuously until a desired quantity compressed insulation has been placed at the site.

Although not illustrated, the deflector portion 124 may also include wings or shields on one or both of its lateral edges along length $L_1$ in order to prevent misplacement of errant insulation following impact thereof with deflector portion 124. Such lateral containment measures are not normally necessary, however, since flowing fibrous insulation behaves more like a continuously flowing stream of discrete particles than a continuously flowing fluid. That is, fibrous insulation striking the rear face of deflector portion 124 normally displays a "simple rebound" as it separates from the deflector portion, i.e., it does not typically bounce laterally or "splatter" in the manner of a fluid striking a hard surface.

Figure 4:
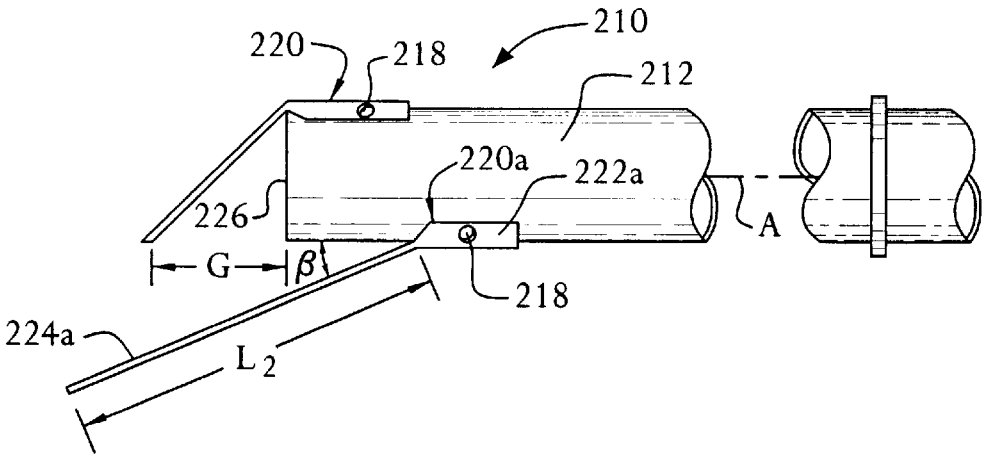
FIG. 4 is a side view of a fibrous insulation delivery system dispensing apparatus constructed in accordance with a further embodiment of the present invention.

Referring to FIG. 4, there is shown a further embodiment of a fibrous insulation dispensing apparatus, identified generally by reference numeral 10, constructed in accordance with the present invention. Dispensing apparatus 210 comprises a pipe 212 and a first deflector means 220. Pipe 212 and first deflector means 220 may be assumed to be constructed consistent with the descriptions of pipe 112 and deflector means 120 of dispensing apparatus 110 and thus will not be described in further detail herein except where necessary to provide a proper understanding of the invention. In addition to first deflector means 220, dispensing apparatus further preferably comprises a second deflector means 220*a* connected to pipe 212 generally diametrically opposite the first deflector means 220. Like the first deflector means 220, the second deflector means 220*a* may include an attachment portion 222*a* and may be mechanically fastened to pipe 212 by fastening means 218 such as screws or the like to enable detachment of the first or second deflector means from the pipe to permit replacement or repair of either deflector means 220, 220*a* or pipe 212. The second deflector means 220*a* may also be adhered, formed integrally with or otherwise affixed to the pipe 212 if a permanent attachment of the second deflector means to the pipe is desired or necessary.

The second deflector means 220*a* is preferably constructed substantially similarly to first deflector means and thus includes a deflector portion 224*a* that is preferably substantially planar or, more preferably, truly planar and may extend at an angle β of between about 10° to about 70° with respect to the longitudinal axis A of pipe 212. The minimum dimensional requirements of deflector portion 224*a* are that its width be at least as great as the diameter of pipe 212 and that its length $L_2$ be sufficient to accommodate at least the orthogonal projection of gap G thereonto.

The operation of dispensing apparatus 210 is essentially identical to that of dispensing apparatus 110 up to the point at which compressed fibrous insulation material passes through gap G. In dispensing apparatus 210 such compressed insulation material then strikes the deflector portion 224*a* of the second deflector means 220*a*. The deflector portion 224*a* absorbs much of the remaining kinetic energy and momentum of the moving compressed fibrous insulation material and causes same to flow from the impingement surface of the deflector portion 224*a* in a quasi-fluid fashion and thereby provide enhanced directional control and placement of the fibrous material at the installation site.

Figure 5:
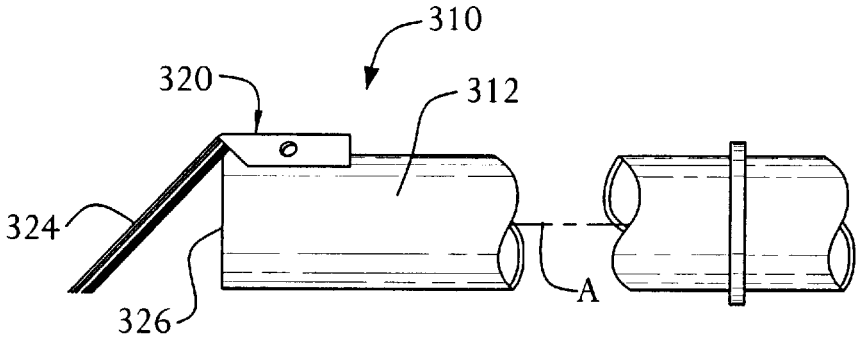
FIG. 5 is a side view of a fibrous insulation delivery system dispensing apparatus constructed in accordance with a further embodiment of the present invention.

FIG. 5 shows a further embodiment of a fibrous insulation dispensing apparatus, generally identified by reference numeral 310, constructed in accordance with the present invention. Apparatus 310 comprises a pipe 312 and a deflector means 320. Except for the deflector portion 324 of deflector means 320, it may be assumed that the remainder of apparatus 310 may be constructed consistent with the descriptions of pipe 112 and deflector means 114 of dispensing apparatus 110. Therefore, only deflector portion 324 and its impact on the operation of dispensing apparatus 310 will be described in detail.

Unlike deflector portion 124 of deflector means 120, the deflector portion 324 of deflector means 320 is preferably not entirely inelastic or rigid. Indeed, deflector portion 324, which presents a substantially planar or, more preferably, a truly planar face with respect to outlet 326 of pipe 312, is preferably somewhat flexible and elastic whereby it partially yields upon impact by moving fibrous material. Nevertheless, it should not be so flexible that it does not provide a firm surface against which moving fibrous material may be compressed. To achieve these desired ends, deflector portion 324 may be fabricated from a blade of suitably stiff yet flexible plastic, natural or artificial rubber, neoprene, polyurethane or the like. Alternatively, as illustrated, deflector portion 324 may assume the form of a brush comprised of densely compacted natural and/or artificial bristles.

An advantage provided by the construction of dispensing apparatus 310 is that the yieldability of deflector portion 324 may reduce clogging of compressed fibrous material adjacent the outlet 326 of pipe 312. It will be understood that, if desired, dispensing apparatus 310 may also include a second deflector means constructed and arranged substantially similar to second deflector means 220*a* of dispensing apparatus 210.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A dispensing apparatus for use with a fibrous material delivery system, said dispensing apparatus comprising:

a pipe having a longitudinal axis, a first end and a second end, said first end being constructed for attachment to a fibrous material delivery conduit of a fibrous material delivery system and same second end terminating at an outlet; and a deflector disposed adjacent said second end for compressing a flow of fibrous material discharged through said outlet and for changing the direction of flow of fibrous material compressed thereby, wherein said deflector comprises a substantially planar portion disposed at an acute angle with respect to said outlet, and said substantially planar portion is yieldable.

2. The apparatus of claim 1, wherein said substantially planar portion has dimensions sufficient to cover an area defined by an orthogonal projection of said outlet onto said planar portion.

3. The apparatus of claim 1, further comprising a second deflector disposed adjacent said second end generally opposite said deflector, for changing the direction of flow of fibrous material compressed by said deflector.

4. A method for dispensing a fibrous material, comprising the steps of:

delivering the fibrous material through a pipe having a longitudinal axis, a first end and a second end, said first end being constructed for attachment to a fibrous material delivery conduit of a fibrous material delivery system, and said second end terminating at an outlet; and simultaneously changing a direction of flow of the fibrous material discharged through said outlet and compressing the flow of the fibrous material, using a deflector disposed adjacent said second end.

5. The method of claim 4, wherein said deflector comprises a substantially planar portion disposed at an acute angle with respect to said outlet.

6. The method of claim 5, wherein said substantially planar portion has dimensions sufficient to cover an area defined by an orthogonal projection of said outlet onto said planar portion.

7. The method of claim 5 wherein said substantially planar portion is rigid.

8. The method of claim 5, wherein said substantially planar portion is yieldable.

9. The method of claim 4, further comprising the step of:

deflecting the fibrous material with a second deflector disposed adjacent said second end generally opposite said deflector, thereby changing the direction of flow of fibrous material compressed by said deflector.

* * * * *